US009062414B2

(12) United States Patent
Chaplin

(10) Patent No.: US 9,062,414 B2
(45) Date of Patent: Jun. 23, 2015

(54) SINGLE LAYER PAPERMAKING FABRICS FOR MANUFACTURE OF TISSUE AND SIMILAR PRODUCTS

(71) Applicant: ASTENJOHNSON, INC., Charleston, SC (US)

(72) Inventor: Derek Chaplin, Kanata (CA)

(73) Assignee: ASTENJOHNSON, INC., Charleston, SC (US)

( * ) Notice: Subject to any disclaimer, the term of this patent is extended or adjusted under 35 U.S.C. 154(b) by 0 days.

(21) Appl. No.: 14/388,951

(22) PCT Filed: Mar. 26, 2013

(86) PCT No.: PCT/CA2013/000280
§ 371 (c)(1),
(2) Date: Sep. 29, 2014

(87) PCT Pub. No.: WO2013/149319
PCT Pub. Date: Oct. 10, 2013

(65) Prior Publication Data

US 2015/0068698 A1 Mar. 12, 2015

(30) Foreign Application Priority Data

Apr. 2, 2012 (CA) ..... 2773501

(51) Int. Cl.
*D03D 3/04* (2006.01)
*D21F 7/12* (2006.01)

(52) U.S. Cl.
CPC ..... *D21F 7/12* (2013.01)

(58) Field of Classification Search
USPC ..... 162/296; 139/383 A
See application file for complete search history.

(56) References Cited

U.S. PATENT DOCUMENTS

| | | | |
|---|---|---|---|
| 3,301,746 | A | 1/1967 | Sanford et al. |
| 3,573,164 | A | 3/1971 | Friedberg et al. |
| 3,603,354 | A | 9/1971 | Lee et al. |
| 3,905,863 | A | 9/1975 | Ayers |
| 4,112,982 | A | 9/1978 | Bugge et al. |
| 4,142,557 | A | 3/1979 | Kositzke |
| 4,191,609 | A | 3/1980 | Trokhan |
| 4,239,065 | A | 12/1980 | Trokhan |
| 4,281,688 | A | 8/1981 | Kelly et al. |

(Continued)

FOREIGN PATENT DOCUMENTS

WO 9104374 A1 9/1997

OTHER PUBLICATIONS

International Search Report and the Written Opinion; PCT/CA2013/000280; International Filing Date: Mar. 26, 2013; Astenjohnson, Inc.; 11 pgs.

*Primary Examiner* — Jacob Thomas Minskey
(74) *Attorney, Agent, or Firm* — Schmeiser, Olsen & Watts, LLP

(57) ABSTRACT

A woven single layer papermakers' fabric, having a sheet support surface and a machine side surface, comprises a set of monofilament machine direction (MD) oriented warp yarns interwoven with a set of monofilament weft yarns in a ten shed repeating weave pattern, wherein in each repeat of the repeating weave pattern, at least 50% of the warp yarns each forms in the sheet support surface at least one long float over nine consecutive weft yarns. Adjacent long floats define elongated MD oriented pockets in the sheet support surface. The fabrics provide improved properties for forming and conveying topographically patterned products such as tissue.

16 Claims, 5 Drawing Sheets

(56) References Cited

U.S. PATENT DOCUMENTS

| | | | |
|---|---|---|---|
| 4,290,209 | A | 9/1981 | Buchanan et al. |
| 4,423,755 | A | 1/1984 | Thompson |
| 4,426,795 | A | 1/1984 | Rudt |
| 4,438,788 | A | 3/1984 | Harwood |
| 4,815,499 | A | 3/1989 | Johnson |
| 4,909,284 | A | 3/1990 | Kositzke |
| 4,989,648 | A | 2/1991 | Tate et al. |
| 4,995,428 | A | 2/1991 | Tate et al. |
| 4,998,569 | A | 3/1991 | Tate |
| 5,013,330 | A | 5/1991 | Durkin et al. |
| 5,103,874 | A | 4/1992 | Lee |
| 5,151,316 | A | 9/1992 | Durkin et al. |
| 5,158,116 | A | 10/1992 | Kazuo et al. |
| 5,211,815 | A | 5/1993 | Ramasubramanian et al. |
| 5,429,686 | A | 7/1995 | Chiu et al. |
| 5,456,293 | A | 10/1995 | Ostermayer et al. |
| 5,542,455 | A | 8/1996 | Ostermayer et al. |
| 5,544,678 | A | 8/1996 | Barret |
| 5,853,547 | A | 12/1998 | Ahrens et al. |
| 6,237,644 | B1 | 5/2001 | Hay et al. |
| 6,649,026 | B2 | 11/2003 | Lamb |
| 6,745,797 | B2 | 6/2004 | Troughton |
| 7,207,356 | B2 | 4/2007 | Patel et al. |
| 7,300,554 | B2 | 11/2007 | LaFond et al. |
| 7,360,560 | B2 | 4/2008 | Barret |
| 7,585,395 | B2 | 9/2009 | Quigley |
| 7,878,223 | B2 | 2/2011 | Kroll et al. |
| 8,114,254 | B2 | 2/2012 | Quigley |
| 2003/0036327 | A1 | 2/2003 | Troughton |
| 2007/0175534 | A1 | 8/2007 | Barret |
| 2008/0169040 | A1 | 7/2008 | Barret |

SINGLE LAYER PAPERMAKING FABRICS FOR MANUFACTURE OF TISSUE AND SIMILAR PRODUCTS

FIELD OF THE INVENTION

The invention concerns papermaking fabrics for use in forming and conveying high bulk, topographically patterned absorbent paper products such as towel, tissue and similar cellulosic products. It is particularly concerned with such fabrics which are intended for use as forming, transfer or through-air drying (TAD) fabrics in tissue making machines.

BACKGROUND OF THE INVENTION

The majority of towel and tissue products are presently manufactured according to one of either the conventional wet pressing (CWP) or through-air drying (TAD) processes. In the CWP process, water is removed from the nascent web by mechanical pressure and the resulting sheet is dry embossed. A disadvantage of this process is that it densifies the web, decreasing bulk and absorbency in the resultant sheet. The TAD process is frequently preferred for the manufacture of tissue and similar cellulosic based absorbent products because it avoids the compressive forces of the dewatering step in the CWP method. In the TAD process, the wet web is formed by depositing a papermaking furnish onto a moving forming fabric where it is initially drained, and then transferring the resulting very wet web onto a TAD fabric, which is generally of a very open and permeable design. The TAD fabric is directed around a permeable drum where the sheet is non-compressively dried by passing hot air through the drum and web while it is held in intimate contact with the fabric. The product may then pass over a subsequent Yankee dryer, which is essentially a large steam cylinder with a polished surface, or the Yankee may be omitted. Through-air dryers may be used either before or after a Yankee dryer to preserve bulk and increase drying efficiency. It is well known that fabrics having a three-dimensional (i.e. non-planar) product side (PS) surface can introduce protuberances into the sheet which can, in turn, impart significantly increased bulk and absorbent capacity to the resulting paper product. The efficiency of the TAD process can be significantly enhanced through the use of single layer, high air permeability fabrics.

A TAD fabric should ideally have sufficient open area to provide the required air flow to the paper web so as to promote efficient drying. The fabric should also have a sufficiently high contact area on its PS to ensure successful transfer of the sheet from the TAD to subsequent dryer elements, such as a Yankee cylinder. Fabrics intended for this purpose and which impart a machine direction (MD) oriented pattern in the sheet are generally preferred over those which create a generally cross-machine direction (CD) oriented pattern because this provides the sheet with a smoother "feel", which is desirable in consumer oriented products such as tissue, towel and similar absorbent products. An MD oriented pattern in the sheet will require longer MD oriented yarn "floats" in the PS, i.e. areas in the fabric where the MD oriented yarns are not bound by the CD yarns. Fabric weave patterns which provide long MD oriented floats will generally also provide higher air permeabilities than patterns which do not.

DISCUSSION OF THE PRIOR ART

TAD fabrics and other papermaking fabrics which are intended to impart a pattern to the paper web formed thereon are well known. See, for example, U.S. Pat. No. 3,301,746 to Sanford et al.; U.S. Pat. No. 3,603,354 to Lee; U.S. Pat. No. 3,905,863 to Ayers; U.S. Pat. No. 4,191,609 and U.S. Pat. No. 4,239,065, both to Trokhan; U.S. Pat. No. 4,281,688 to Kelly et al.; U.S. Pat. No. 4,423,755 to Thompson; U.S. Pat. No. 4,909,284 to Kositzke; U.S. Pat. No. 4,989,648, U.S. Pat. No. 4,995,428 and U.S. Pat. No. 4,998,569, all to Tate et al.; U.S. Pat. No. 5,013,330 and U.S. Pat. No. 5,151,316 to Durkin et al.; U.S. Pat. No. 5,158,116 to Tate et al.; U.S. Pat. No. 5,211,815 to Ramasubramanian et al.; U.S. Pat. No. 5,456,293 and U.S. Pat. No. 5,542,455 both to Ostermayer et al.

There are various means disclosed in the prior art by which the fabrics intended to impart a surface patterning to the web may do so. For example, U.S. Pat. No. 5,429,686 to Chiu et al. discloses forming fabrics which include a load-bearing layer and a sculptured layer. The fabrics utilize impression knuckles to imprint the sheet and increase its surface contour U.S. Pat. No. 7,585,395 to Quigley et al. discloses a forming fabric for an ATMOS™ tissue forming system in which, in the fabric weave pattern, each of the weft yarns sequentially passes over three warp, under one, over one, under three, over one, and under one warp yarn, the sequence then repeating. U.S. Pat. No. 8,114,254 to Quigley discloses a single layer forming or TAD fabric having pockets on its PS which are defined by four sides, three of the four being formed by single yarn knuckles, and the last side being formed by a knuckle of a weft and warp; the weft yarn also defines the bottom of the pocket.

U.S. Pat. No. 6,237,644 to Hay et al. discloses forming fabrics woven according to a lattice weave pattern of at least three yarns oriented in both warp and weft directions, resulting in shallow craters in distinct patterns.

U.S. Pat. No. 7,300,554 to Lafond et al. discloses fabrics constructed so that the sheet side surface has topographical differences measured as a plane difference between at least two weft which have at least two different diameter or shaped yarns to impart bulk into a tissue sheet.

U.S. Pat. No. 6,649,026 to Lamb discloses structured sanded forming fabrics which utilize pockets based on five-shaft designs and with a float of three yarns in both warp and weft directions (or variations thereof).

U.S. Pat. No. 7,878,223 to Kroll et al. discloses forming fabrics which utilize a series of two alternating sized pockets for TAD applications. The pockets are bounded by raised warp and weft knuckles in the fabric pattern. The first pockets are preferably larger in area than the second pockets.

It is known from U.S. Pat. No. 4,142,557 to Kositzke, U.S. Pat. No. 4,290,209 to Buchanan et al., U.S. Pat. No. 4,438,788 to Harwood, U.S. Pat. No. 4,815,499 to Johnson, and U.S. Pat. No. 5,103,874 to Lee, amongst others, to use rectangular, square or generally flattened yarns in the manufacture of papermaking fabrics. From U.S. Pat. No. 3,573,164 to Friedberg et al., and U.S. Pat. No. 4,426,795 to Rudt, it is known to increase contact area with the sheet by abrading the weave knuckles of the interwoven yarns. More recently, U.S. Pat. No. 7,207,356 to Patel et al. discloses a single layer TAD fabric woven using flat warp and/or weft yarns to provide a fabric having between 20% to 30% contact area with the paper sheet without need to sand or otherwise abrade the fabric surface.

However, none of the prior art discloses single layer fabrics for use in tissue forming or TAD applications which include relatively long MD oriented floats, wherein adjacent floats provide elongated pockets, and which provide the required air permeability and sheet support surface contact area.

It has now been found that single layer fabrics can be woven to patterns providing long MD floats, where at least some of the warp yarns pass over nine weft yarns, and in which adjacent floats pass together over at least two common weft yarns, and wherein adjacent floats provide elongated pockets therebetween, as defined below. It has further been found that such single layer woven fabrics can include a sheet support surface which provides a contact area with the paper sheet that is from at least 20% to 40% or more, which has an air permeability of from at least 500 to 900 cubic feet per minute (CFM) (8300 to 15000 $m^3/m^2/hr$) or more, and whose sheet support surface is structured and arranged to impart bulk and similar desirable properties in the paper product formed thereon by means of MD oriented yarn floats and pockets.

As used herein, the term "float" refers to the number of successive yarns on the surface of a fabric that a given yarn passes over (or under) without interweaving with another yarn in one repeat of a woven fabric; floats may be formed by either a warp yarn or a weft yarn. For example, in one repeat of the weave pattern of the fabrics of the present invention, a warp yarn will interweave with a weft yarn, and then pass over as many as nine successive weft yarns on the sheet support surface of the fabric before it next interweaves with the next weft yarn.

The related term "knuckle" refers to the protuberance of a yarn from the surface of the fabric at an interweaving point with a transverse yarn. When a knuckle is formed on the sheet support surface, its prominence is sufficient to form a distinct impression on the sheet being conveyed.

A "pocket" refers to a depression formed between two warp yarns in the sheet support surface of a fabric, where the depression extends from the top PS surface of a warp yarn knuckle down to the top of a weft yarn in the depression. Pocket depth is quantified as the Z-direction distance from the sheet support surface top of a warp yarn at a knuckle to the top of a weft yarn at the bottom center of the adjacent pocket. In the fabrics of the invention, pocket depth is at least equal to the diameter or Z-direction thickness of a warp yarn. Pocket depth can be measured either by microtome sectioning of the fabric, or by electronically scanning the fabric to provide a three dimensional profile.

The term "sheet support surface" refers to the generally planar PS surface of the fabric on which the paper product is formed or conveyed; the opposing surface of the fabric, which is in contact with the various stationary elements or rotating rolls of the machine, is referred to as the "machine side" or MS.

The term "surfacing" refers to an abrasive process in which a portion of a planar surface of a fabric is removed, for example, by means of a rotating sanding roll or similar process. Surfacing removes a portion of the yarn material from the warp and weft yarn knuckles of the fabric. Surfacing is often carried out to increase the contact area between the sheet support surface of a fabric and the paper product it is conveying; surfacing is an optional process.

The term "MD" refers to the machine direction, or direction from the headbox to the reel in which the paper product moves as it passes through the machine; the term "CD" refers to the cross-machine direction, which is perpendicular to the MD in the plane of the paper product.

The term "caliper" refers to the overall average Z-direction thickness of the fabric as measured from the tops of the warp yarn knuckles in the sheet support (PS) surface through to the bottoms of the yarns on the opposite MS fabric surface; fabric caliper is typically measured using a barrel micrometer or similar instrument.

A "single layer" fabric is one that is woven according to a chosen pattern from single sets of warp and weft yarns, and in which neither the warp nor the weft yarns is stacked in vertical orientation in relation to another of the same yarns in the fabric.

The term "shed" refers to the number of individual heddle frames used in the loom to control the position of the warp yarns as a fabric is woven according to a chosen pattern.

The fabrics of the present invention are woven according to patterns requiring 10 sheds in the loom, and are thus "10-shed" patterns.

The term "pattern repeat" (and related term "weave pattern") refers to the unique manner and sequence in which the warp and weft yarns are interlaced (pass over and under one another as the fabric is woven) before the unique interlacing sequence is restarted. In the fabrics of the present invention, the pattern repeat requires ten warp yarns and at least ten weft yarns. The pattern repeat is sometimes referred to as the "unit cell" in woven cloth as it is the minimum number of uniquely interlaced warp and weft yarns required to produce the entire fabric as woven to the pattern repeat.

SUMMARY OF THE INVENTION

The present invention seeks to provide a woven single layer papermakers' fabric having a sheet support surface and a machine side surface and comprising a set of monofilament machine direction (MD) oriented warp yarns interwoven with a set of monofilament weft yarns in a ten shed repeating weave pattern, wherein in each repeat of the repeating weave pattern, at least 50% of the warp yarns each forms in the sheet support surface at least one long float over nine consecutive weft yarns.

In some embodiments, 100% of the warp yarns form floats passing over nine consecutive weft yarns, in which case preferably for each two adjacent warp yarns, their long floats extend concurrently in the MD for at least 20% of their respective lengths.

Preferably, for each adjacent two warp yarns, in each repeat of the repeating weave pattern the two warp yarns float concurrently adjacently over at least one group of at least two weft yarns.

Preferably, for each two adjacent warp yarns, their adjacent long floats together with associated weft knuckles define MD oriented pockets in the sheet support surface; and preferably the pockets comprise first and second pockets alternating in the MD, the first pockets being longer in the MD than the second pockets. More preferably, the first pockets extend over six weft yarns and the second pockets extend over two weft yarns.

Preferably, the pockets have a maximum pocket depth, as measured from the top of a yarn float on the sheet support surface to the top of a weft yarn below, of about 60% of the fabric caliper.

Preferably, the contact area of the sheet support surface is between 20% and 40%, more preferably between 30% and 40%.

Optionally, the surfaces of at least some of the warp and weft yarns in the sheet support surface of the fabric comprise abraded areas, and the contact area of the sheet support surface is at least 30%.

Preferably, the warp yarns have a cross-sectional shape selected from one of circular, ovate, elliptical, rectangular, trapezoidal and square, and the weft yarns have a cross-sectional shape selected from one of circular, ovate, elliptical, rectangular, trapezoidal and square.

In some embodiments, the warp yarns and the weft yarns each have a circular cross-sectional shape. In other embodiments, the cross-sectional shape of the warp yarns is rectangular and the cross-sectional shape of the weft yarns is circular.

Preferably, the fabrics of the invention have an air permeability of between 500 and 900 cubic feet/min (8300 to 15000 $m^3/m^2/hr$).

Preferably, the fabrics of the invention have an open area of between 25% and 40%.

DETAILED DESCRIPTION OF THE DRAWINGS

Figure 1:
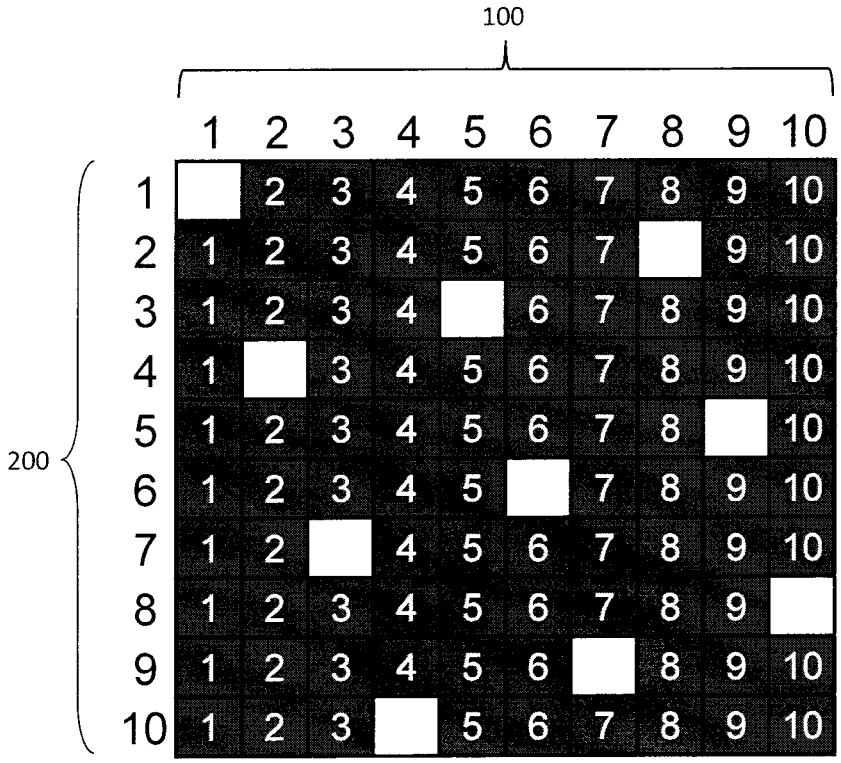
FIG. 1 is a weave pattern of a fabric according to an embodiment of the invention.

FIG. 1 is a weave diagram showing one pattern repeat of a single layer fabric according to a first embodiment of the invention. In the diagram, the warp yarns 100 are numbered 1 to 10 across the top of the pattern, while the weft yarns 200 are numbered 1 to 10 along the left side. As is conventional in these diagrams, black squares indicate that a warp yarn is passing over a weft yarn at that location in the fabric as woven, while white squares show that a warp yarn is passing under a weft yarn.

As shown in FIG. 1, warp yarn 1 passes under weft yarn 1 to interweave with it, and then floats over weft yarns 2 to 10 to complete the full pattern repeat. Similarly, warp yarn 2 floats over weft yarns 1, 2 and 3, passes under weft yarn 4, then over weft yarns 5 to 10 to complete the repeat. All of the warp yarns in the pattern follow paths similar to that described in relation to warp yarns 1 and 2 and all form long floats over nine weft yarns in one repeat of the pattern. The knuckles formed by these long floats create localized protrusions and regions of low fiber density in the sheet being formed or conveyed by the fabric.

It can also be seen that any two adjacent warp yarns, such as warp yarns 1 and 2 in FIG. 1, both pass together over two common well yarns, such as well yarns 2 and 3, before interlacing with a well yarn to form an MS knuckle. The same interweaving occurs throughout the pattern repeat: warp yarns 2 and 3 both pass over well yarns 5 and 6; warp yarns 3 and 4 both pass over weft yarns 8 and 9, and so on. Thus, for any two adjacent warp yarns, both will pass together over at least two common well yarns before one of the warp yarns passes under a well yarn to form an MS warp knuckle.

Figure 2:
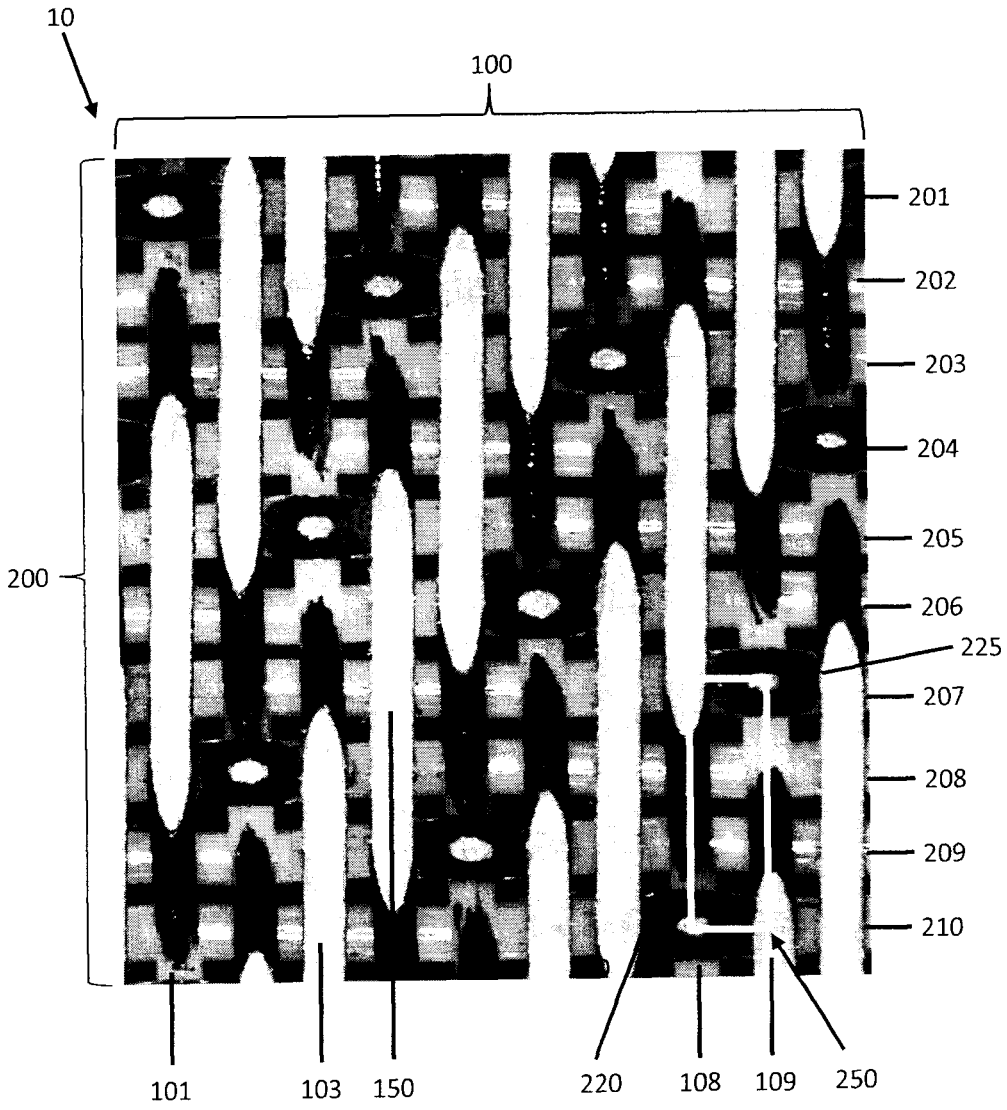
FIG. 2 is a photograph of the PS surface of a fabric woven according to the weave pattern of FIG. 1.

FIG. 2 is a photograph of the sheet support surface of a fabric 10 woven according to the pattern shown in FIG. 1 and showing one pattern repeat of the fabric weave pattern shown in FIG. 1. The warp yarns 100 extend vertically and are arranged from left to right in the photograph while the well yarns 200 extend horizontally and are arranged from top to bottom and are numbered from 201 to 210; there are ten warp yarns 100 and ten weft yarns 200 in FIG. 2; warp yarns 101, 103, 108 an 109 are identified. Each of the warp yarns 100 forms long floats over nine weft yarns 200; warp yarn 101 is exemplary and floats over weft yarns 202 to 210 and then interlaces with weft yarn 201 in the pattern repeat.

The fabric shown in each of FIGS. 2 to 5 was woven with the following properties:

Yarn Count: Warp 43.5/in (17.1/cm) and Weft 40/in (15.7/cm)

Warp diameter: 0.35 mm and Weft diameter: 0.45 mm (circular)

Air Permeability: 710 cubic feet per minute (11,700 $m^3/m^2/hr$)

Caliper: 0.044 in. (1.12 mm)

Contact area (%): 33.3

While it is not necessary that this be done, the sheet support surface of the fabric shown in FIG. 2 has been surfaced by abrasive means so as to remove a portion of the warp yarn material from the warp knuckles, such as the area shown at 150, where the abraded region is shown as white, and the unabraded portion remains dark, and to remove a portion of the weft yarn material from the weft yarn knuckles, as shown at 220 and 225; this process increases the surface contact area between the paper sheet and fabric. For example, surfaced area 150 has had about 0.075 mm of polymeric material removed in the surfacing process; other warp yarns are similar. Following a surfacing process, the fabric 10 shown in FIG. 2 has an MD contact area (i.e. along the warp yarns 100) of 32.2% and a CD contact area (i.e. along the weft yarns 200) of about 1.1% which together provide for a total fabric contact area between the fabric and sheet of about 33.3%.

It is also possible to weave a fabric similar to that shown in FIG. 2 using generally rectangular, square or other non-round cross-sectional shaped monofilaments as either or both the warp and/or weft yarns. If this is done, then the surfacing step utilized in relation to the fabric shown in FIG. 2 could either be avoided, or the amount of abrasion could be reduced. The amount of fabric contact area required for fabrics according to the invention will vary depending on the intended end use environment.

FIG. 2 also shows a further feature of the fabrics of the invention. It can be seen that weft yarn 210 forms a knuckle 220 on warp yarn 108 as it interlaces with that yarn; similarly, weft yarn 207 forms a knuckle 225 as it interlaces with adjacent warp yarn 109. As shown in the area 250, for each of the two adjacent warp yarns 108 and 109, each warp yarn passes over and adjacently overlaps at least two common weft yarns such as 208 and 209 before one of the two warp yarns passes under a weft yarn to form an MS warp knuckle, such as occurs at weft knuckles 220 and 225.

Figure 3:
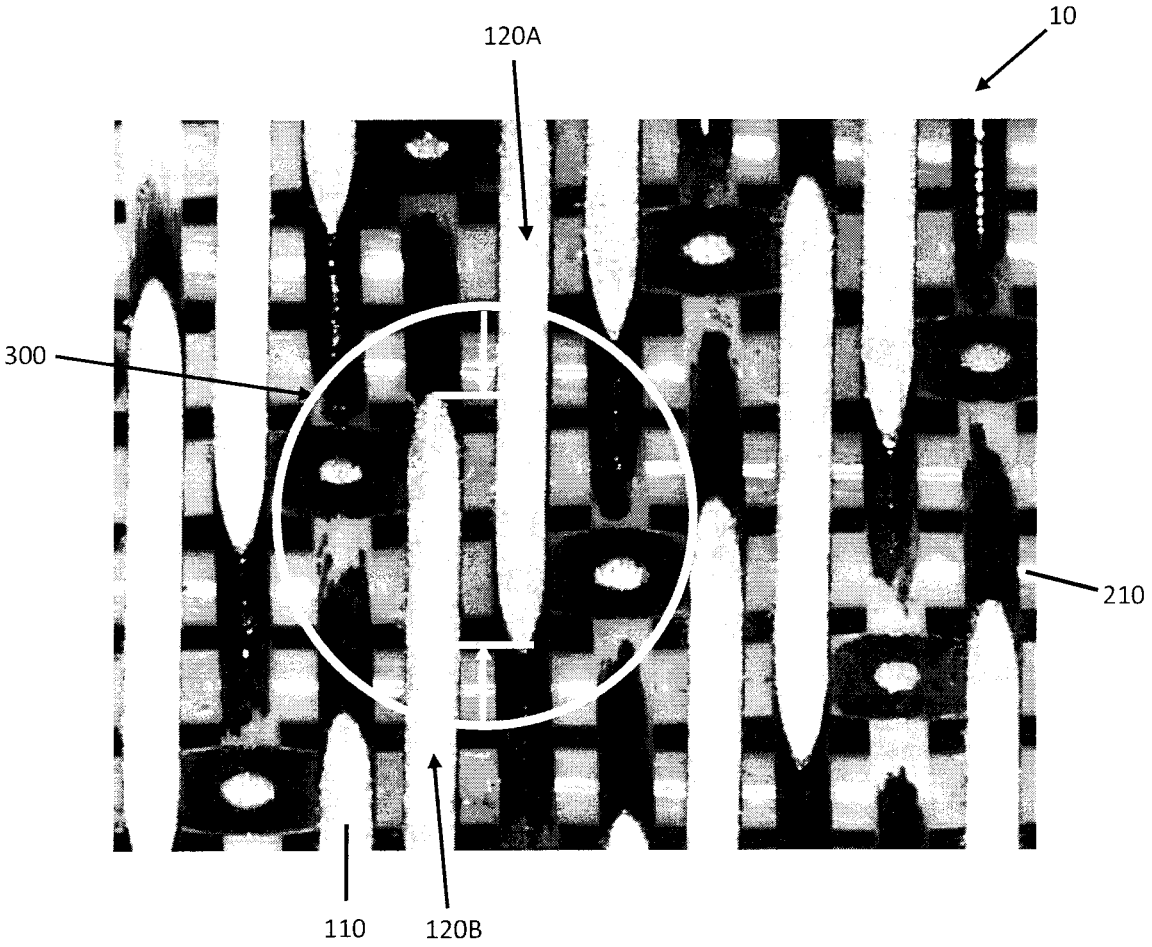
FIG. 3 is an enlarged photograph of a portion of FIG. 2.

FIG. 3 is an enlarged view of a portion of the fabric shown in FIG. 2 and showing a further feature of the fabrics of the present invention regarding the overlap region of two adjacent warp yarn floats. As in FIG. 2, the warp yarns such as 110 are oriented vertically and the weft yarns such as 210 are oriented horizontally in the photograph. In the fabrics of the invention such as shown in FIG. 3, the MD oriented warp yarn floats on any two adjacent warp yarns will be partly concurrent with each other, and be coplanar, over an MD distance equal to at least about 20% of their float length. FIG. 3 shows one concurrent region of two adjacent warp yarn floats, shown as 120A and 120B in the fabric 10. The relative size of this area of concurrency is indicated by the horizontal lines and vertical arrows presented within the circle 300. Within this region between the horizontal lines, the warp knuckles 120A and 120B are coplanar with one another. The knuckles 120A and 120B are also coplanar with other similar warp knuckles in the sheet support surface of the fabric, regardless of whether or not the fabric has been subjected to a surfacing process.

As noted above, the fabric 10 shown in FIGS. 2 and 3 was woven using circular cross-section 0.35 mm diameter polyester terephthalate (PET) warp yarns such as 110, and 0.45 mm diameter PET weft yarns such as 210. In the fabric shown in FIG. 3, the total length of a warp knuckle, such as 120A or 120B as it floats over nine consecutive weft yarns 210 in the pattern repeat, before interlacing with a tenth weft yarn, was measured and found to be about 3.03 mm; this warp float length recurs throughout the fabric for all of the warp yarn floats. The length of coplanar concurrent paths of adjacent warp yarns 120A and 120B (as shown between the horizontal lines in the circle 300) was also measured and was found to be about 1.25 mm, or about 41% of the total warp float length [i.e. (1.25/3.03)×100=41%]. This large coplanar concurrent path of the warp floats in the fabric 10 is desirable as it provides a continuity of MD contact area across the warp yarn floats in the fabric and thus in the paper product conveyed by the fabric which in turn improves the reliability of sheet transfer to subsequent downstream machine sections during the papermaking process.

Figure 4:
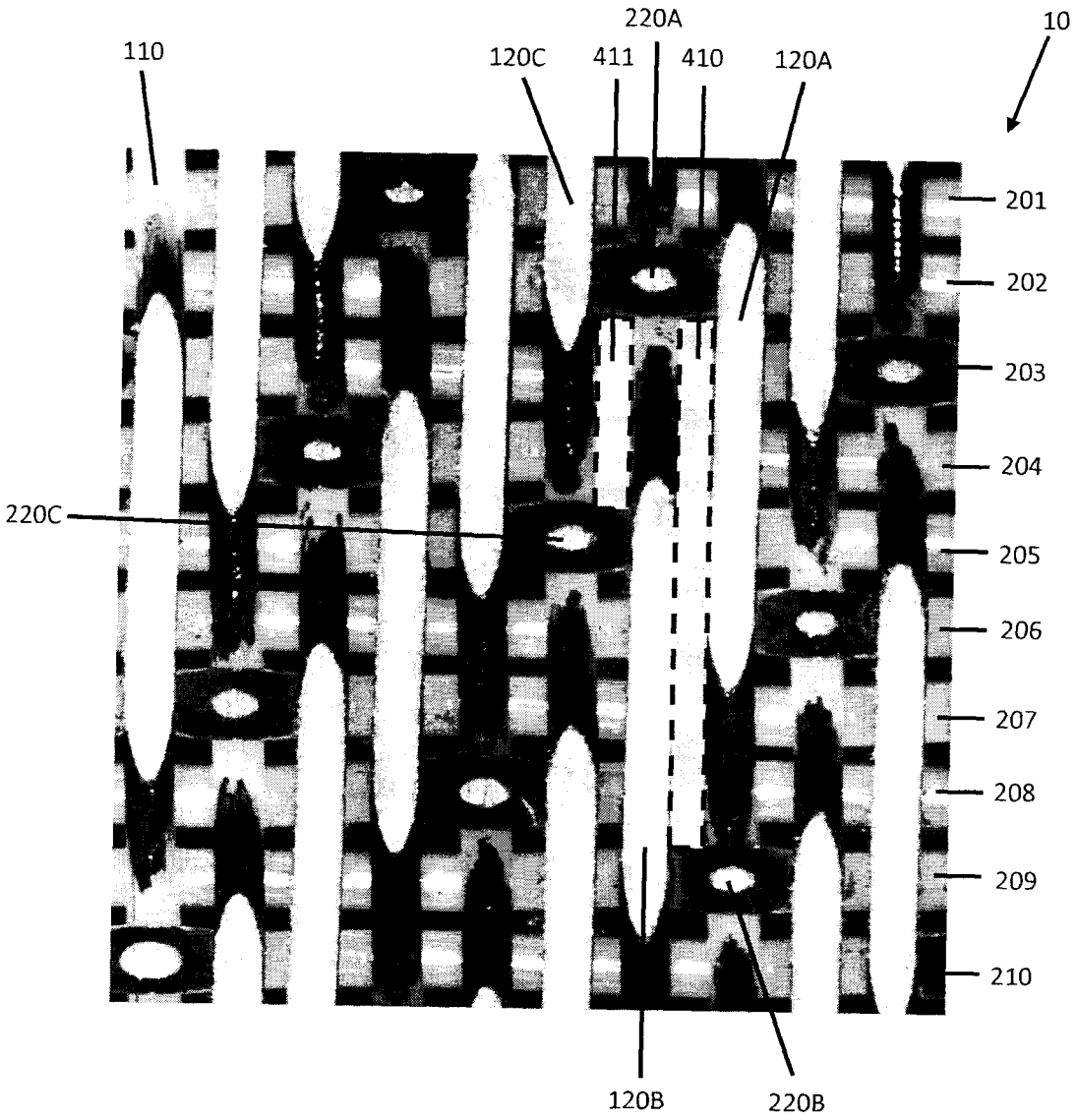
FIG. 4 is a photograph of the PS surface of a fabric woven according to the weave pattern of FIG. 1.
Figure 5:
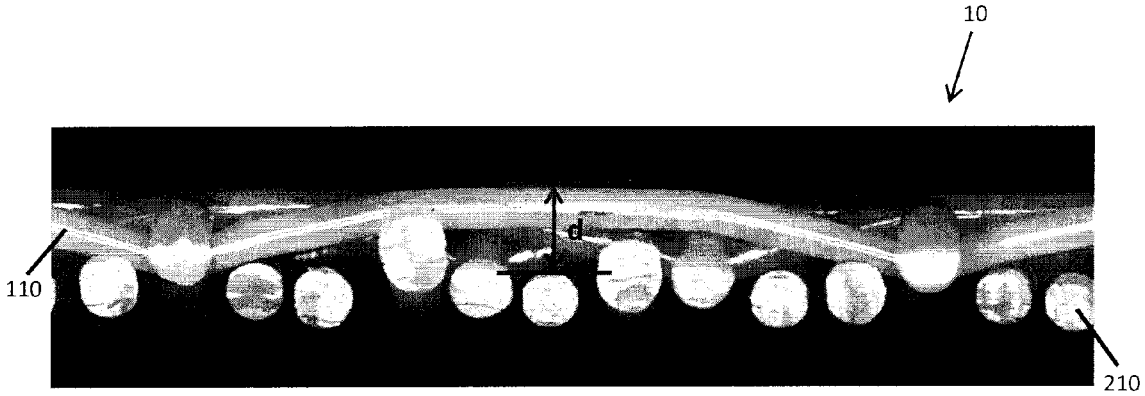
FIG. 5 is a cross section taken along a warp yarn in the fabric of FIG. 2.

FIG. 4 illustrates another feature of fabrics made in accordance with the teachings of the present invention. FIG. 4 is a photograph of the sheet support surface of the fabrics previously presented in FIGS. 2 and 3 in which two representative pockets 410 and 411 in the sheet support surface are indicated in white with dotted outline and which are located between adjacent warp knuckles 120A, 120B and 120C. Pocket 410, which is the larger pocket, is bordered by warp knuckles 120A and 120B, and extends in the MD from sheet support surface weft knuckles 220A to 220B over six weft yarns 203 to 208 in the longitudinal direction of the sheet support surface of fabric 10. Pocket 411, which is the smaller pocket, is bordered by warp knuckles 120B and 120C, as well as weft knuckles 220A and 220C and extends over two weft yarns 203 and 204 in the longitudinal direction of fabric 10. Thus, it can be seen from FIG. 4 that the warp yarn floats such as 120A, 120B and 120C of adjacent warp yarns form both short pockets such as 411 (between floats 120B and 120C) and long pockets such as 410 (between floats 120A and 120B) throughout the sheet support surface of the fabric. The pocket depth of each pocket 410 and 411 is the Z-direction distance perpendicular to the plane of the sheet support surface top of a surfaced yarn, such as 120A, to the PS top of the weft yarns, such as weft yarns 203 to 208, which are exposed in the bottom of the pocket and will be at least equal to the thickness, or diameter, of the warp yarns 120A, 120B at that location. Similarly, the depth of pocket 411 will be the Z-direction distance from the top of a warp yarn such as 120B in the sheet support surface to the tops of the exposed weft yarns, such as 203 and 204 in the bottom of the pocket.

In the fabric 10, larger pockets such as 410 have an MD length of about 4.23 mm and a CD width of about 0.21 mm to provide a pocket area of about 0.89 $mm^2$ for each larger pocket in the fabric; as woven there are about 26.5 pockets/$cm^2$ (171 pockets/$in^2$) similar to larger pocket 410 throughout fabric 10. Smaller pocket 411 has an MD length of about 1.56 mm, and a CD width of 0.21 mm to provide an area of about 0.33 $mm^2$ to the smaller pockets in the fabric; as woven, there are about 26.5 smaller pockets/$cm^2$ (171 pockets/$in^2$) throughout the fabric.

As discussed above in relation to FIG. 4, the pockets have a depth extending from the top of the sheet support surface into the fabric interior to the PS tops of the weft yarns over which the warp yarns float. Pocket depth is defined by the Z-direction distance between the top of the warp yarns in the sheet support surface and the top of the weft yarns at the bottom center of the pocket. This feature is illustrated in the photograph shown in FIG. 5 which shows a warp yarn such as 110 interwoven with a plurality of weft yarns such as 210 in a cross-section through fabric 10. The pocket depth, d, is indicated as the distance from the top or maximum height of the warp yarn float to the PS top of the weft yarns 210 at the bottom center of the pocket. In the fabrics of the invention, this distance d is typically about 60% of fabric caliper (fabric thickness) and is at least equal to the thickness, or diameter, of the warp yarns. In the fabric shown in FIG. 5, this depth d measures about 0.686 mm (0.027 in.) while the overall fabric caliper is about 1.12 mm (0.044 in.).

Figure 6A:
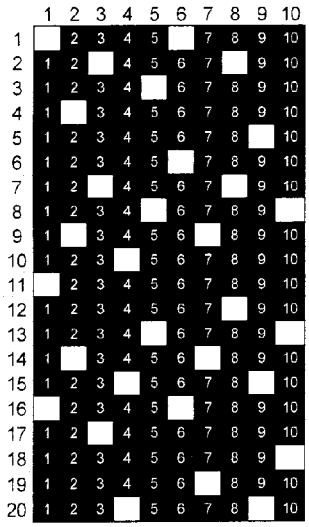
FIGS. 6A, 6B and 6C are three weave diagrams of fabrics according to additional embodiments of the invention.
Figure 6B:
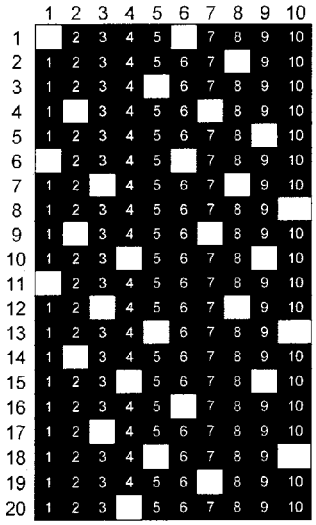
Figure 6C:
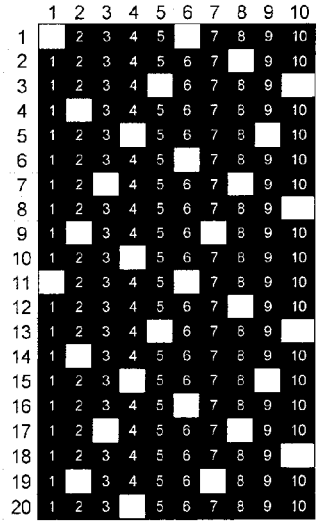

FIGS. 6A, 6B and 6C are weave diagrams showing one pattern repeat of three further embodiments of fabrics designed in accordance with the teachings of the invention. In each of these weave diagrams the weft repeat length, or number of weft yarns required in the pattern repeat, is twenty yarns as opposed to ten in the design shown in FIG. 1. In these three figures, as in FIG. 1, the warp yarns are numbered from 1 to 10 across the top of the weave diagram while the weft yarns are numbered from 1 onwards from the upper left of the design. The fabric constructions are all single layer fabrics.

FIG. 6A shows a first alternate embodiment of the invention, in which warp yarn 1 is exemplary. In this pattern, warp yarn 1 passes under weft yarn 1 (white square at upper left of pattern), then floats over weft yarns 2 to 10 to pass under weft yarn 11. In this first half of the pattern, warp yarn 1 forms a float over nine consecutive weft yarns, as in the design shown in FIG. 1. Warp yarn 1 then floats over weft yarns 12, 13, 14 and 15, passes under weft yarn 16, and then floats over remaining weft yarns 17, 18, 19 and 20 at which point the pattern repeats. Similarly, adjacent warp yarn 2 floats over weft yarns 15, 16, 17, 18, 19, 20, 1, 2 and 3 to form a float over nine consecutive weft yarns; warp yarn 2 then passes under weft yarn 4, over weft yarns 5, 6, 7 and 8, under weft yarn 9 and then over weft yarns 10, 11, 12 and 13, and then under weft yarn 14 at which point the pattern repeats. The remaining eight warp yarns in the pattern are interwoven in a like manner with the weft yarns. Inspection of the pattern shown in FIG. 6A reveals two features of the design: (1) in each repeat of the weave, as in the first embodiment shown in FIG. 1, all of the warp yarns each form floats over nine consecutive weft yarns; and (2) in each repeat, all of the warp yarns float over two groups of four successive weft yarns, each group being separated from the next by one weft yarn.

The pattern shown in FIG. 6B is similar to that shown in FIG. 6A, the main difference being in the paths of warp yarns 1, 3, 5, 7 and 9 which are each shifted in relation to their orientation in FIG. 6A. In FIG. 6B, warp yarn 1 passes under weft yarn 1, then over weft yarns 2, 3, 4 and 5 to form a four-weft yarn float; it then passes under weft yarn 6, and over weft yarns 7, 8, 9 and 10 to form a second four-weft yarn float. Warp yarn 1 then passes under weft yarn 11, and then over all of weft yarns 12 to 20 to form a nine-weft yarn float. Warp yarns 3, 5, 7 and 9 follow paths similar to that of warp yarn 1, only each is shifted in relation to warp yarn 1 (e.g. the first interlacing from the top of the pattern for warp yarn 3 is at weft yarn 7 as compared to weft yarn 1 for warp yarn 1, then weft yarn 13 for warp yarn 5, and so on). As in FIG. 6A, warp yarn 2 floats over weft yarns 15, 16, 17, 18, 19, 20, 1, 2 and 3 to form a float over nine consecutive weft yarns; warp yarn 2 then passes under weft yarn 4, over weft yarns 5, 6, 7 and 8, under weft yarn 9 and then over weft yarns 10, 11, 12 and 13, and then under weft yarn 14 at which point the pattern repeats. The path of warp yarns 4, 6, 8 and 10 is identical that of warp yarn 2, only each is shifted down in the pattern repeat by six weft yarns in comparison.

All ten warp yarns in the pattern shown in FIG. 6B exhibit a warp yarn float that extends over nine weft yarns, similar to that shown in FIG. 6A. Unlike the pattern shown in FIG. 6A, it can be seen that, due to the shifted position of the paths of warp yarns 1, 3, 5, 7 and 9 there is now formed a broad twill line of warp floats extending from the upper left to the lower right of the pattern and in which no interweaving between the warp and weft occur, and the warp floats thus extend continuously. This serves to increase the contact area between the sheet side of the fabric and the paper product it conveys, which contact area (due to the continuous and long warp floats) also imparts a topography to the paper sheet conveyed by the fabric.

The pattern shown in FIG. 6C illustrates a further embodiment of the invention. In this pattern, each of warp yarns 1, 3, 5, 7 and 9 forms two floats over nine consecutive weft yarns in each repeat of the weave pattern. For example, warp 1 interweaves with weft 1 and then floats over weft yarns 2 to 10, passes under to interweave with weft yarn 11, and then floats over weft yarns 12 to 20 to form two long warp floats in one pattern repeat. Warp yarn 3 floats over weft yarns 18, 19 and 20, then over weft yarns 1 to 6 to form a first float over nine weft yarns; warp yarn 3 then passes under weft yarn 7 and floats over weft yarns 8 to 16 to form a second float over nine weft yarns. The paths of warp yarns 5, 7 and 9 are similar to those of warp yarns 1 and 3, but they are shifted in the pattern in relation to those yarns. By comparison, warp yarns 2, 4, 6, 8 and 10 each form four four-weft yarn floats in the pattern repeat. For example, warp yarn 2 passes over weft yarns 20, 1, 2 and 3, under weft yarn 4, over weft yarns 5, 6, 7 and 8 to form a first and second float, under weft yarn 9, over weft yarns 10, 11, 12 and 13 to form a third float, under weft yarn 14, and over weft yarns 15 to 18 to form a fourth float. Thus, in the fabric pattern shown in FIG. 6C, every second warp yarn (i.e. 50% of the warp yarns) forms floats over nine weft yarns, while the remainder of the warp yarns form shorter four-weft floats. This may assist to increase the dimensional stability of fabrics woven according to the pattern of FIG. 6C.

For weaving fabrics according to the patterns shown in FIGS. 6A to 6C, the same physical properties can be selected as for the fabrics of FIGS. 2 to 5; however, other cross-sectional shapes and yarns sizes may be used depending on the intended end use of the fabric.

The fabrics of the present invention are woven at a mesh (number of warp yarns per unit width) and knocking (number of weft yarns per unit length) that is suitable for their intended end use in the production of tissue and similar products. In general, as noted above, the fabrics of the invention will have an air permeability ranging from about 500 to 900 CFM (about 8300 to 15000 $m^3/m^2/hr$). The fabrics will have an open area that may range from about 25% to about 40% and are woven at a mesh (number of warp yarns/unit length) of from 30 yarns/in. to about 80 yarns/in. (11.8 yarns/cm to 31.5 yarns/cm) and knocking (number of weft yarns/unit length) of from about 25 yarns/in. to about 65 yarns/in. (9.8 yarns/cm to about 25.6 yarns/cm). The warp and weft yarn diameters (or thickness if generally rectangular) may range from about 0.1 mm to about 1 mm but will ideally be in a range of from about 0.2 mm to about 0.6 mm. Thus, the fabrics of the present invention are suitable for use in any of the forming, transfer or TAD sections of the papermaking machine as appropriate.

The invention claimed is:

1. A woven single layer papermakers' fabric having a sheet support surface and a machine side surface, comprising:

a set of monofilament machine direction (MD) oriented warp yarns interwoven with a set of monofilament weft yarns in a ten shed repeating weave pattern, wherein in each repeat of the ten shed repeating weave pattern, each of the set of monofilament MD oriented warp yarns forms in the sheet support surface at least one long float over nine consecutive weft yarns.

2. A fabric according to claim 1, wherein for each adjacent two warp yarns, in each repeat of the repeating weave pattern the two warp yarns float concurrently adjacently over at least one group of at least two weft yarns.

3. A fabric according to claim 1, wherein for each two adjacent warp yarns, their adjacent long floats together with associated weft knuckles define a plurality of MD oriented pockets in the sheet support surface.

4. A fabric according to claim 3, wherein for each two adjacent warp yarns, the plurality of MD oriented pockets comprise a first plurality of pockets and a second plurality of pockets alternating in the MD, the first plurality of pockets being longer in the MD than the second plurality of pockets.

5. A fabric according to claim 4, wherein the first plurality of pockets extend over six weft yarns and the second plurality of pockets extend over two weft yarns.

6. A fabric according to claim 3, wherein the plurality of MD oriented pockets have a maximum pocket depth, as measured from a top of a yarn float on the sheet support surface to a top of a weft yarn below, of about 60% of a caliper of the fabric.

7. A fabric according to claim 1, wherein a contact area of the sheet support surface is between 20% and 40%.

8. A fabric according to claim 7, wherein the contact area of the sheet support surface is between 30% and 40%.

9. A fabric according to claim 1, wherein the surfaces of at least some of the warp and weft yarns in the sheet support surface of the fabric comprise a plurality of abraded areas, and a contact area of the sheet support surface is at least 30%.

10. A fabric according to claim 1 wherein for each two adjacent warp yarns, their long floats extend concurrently in the MD for at least 20% of their respective lengths.

11. A fabric according to claim 1, wherein the set of monofilament MD oriented warp yarns have a cross-sectional shape of at least one of circular, ovate, elliptical, rectangular, trapezoidal and square, and the set of monofilament weft yarns have a cross-sectional shape of at least one of circular, ovate, elliptical, rectangular, trapezoidal and square.

12. A fabric according to claim 11, wherein the set of monofilament MD oriented warp yarns and the set of monofilament weft yarns each have a circular cross-sectional shape.

13. A fabric according to claim 11, wherein the cross-sectional shape of the set of monofilament MD oriented warp yarns is rectangular and the cross-sectional shape of the set of monofilament weft yarns is circular.

14. A fabric according to claim 1, having an air permeability of between 500 and 900 cubic feet/min (8300 to 15000 $m^3/m^2/hr$).

15. A fabric according to claim 1, having an open area of between 25% and 40%.

16. A fabric according to claim 1, wherein a contact area of the sheet support surface is between 20% and 40% or more.

* * * * *